US010786083B1

(12) United States Patent
Chen et al.

(10) Patent No.: US 10,786,083 B1
(45) Date of Patent: Sep. 29, 2020

(54) FOLDING CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 173 days.

(21) Appl. No.: 16/474,571

(22) PCT Filed: Jan. 22, 2017

(86) PCT No.: PCT/CN2017/000128
§ 371 (c)(1),
(2) Date: Jun. 28, 2019

(87) PCT Pub. No.: WO2017/133369
PCT Pub. Date: Aug. 10, 2017

(30) Foreign Application Priority Data

Feb. 1, 2016 (CN) ..... 2016 1 0069723

(51) Int. Cl.
*A47C 4/28* (2006.01)
*A47C 4/32* (2006.01)
*A47C 4/42* (2006.01)

(52) U.S. Cl.
CPC ..... *A47C 4/28* (2013.01)

(58) Field of Classification Search
CPC ..... A47C 4/28
USPC ..... 297/45, 16.1, 16.2, 42
See application file for complete search history.

(56) References Cited

U.S. PATENT DOCUMENTS 6,082,813 A * 7/2000 Chen ..... A47C 4/286 297/45 X
6,170,907 B1 * 1/2001 Tsai ..... A47C 1/12 297/45 X
6,179,374 B1 * 1/2001 Tang ..... A47C 4/286 297/45 X
6,634,705 B1 * 10/2003 Zheng ..... A47C 4/286 297/45 X
6,736,450 B2 * 5/2004 Miyagi ..... A47C 4/286 297/45 X
6,752,414 B1 * 6/2004 Waldron ..... A47C 4/286 297/45 X (Continued)

FOREIGN PATENT DOCUMENTS

CN 2684653 Y 3/2005
CN 201492050 U 6/2010

(Continued)

*Primary Examiner* — Rodney B White
(74) *Attorney, Agent, or Firm* — Bayramoglu Law Offices LLC

(57) ABSTRACT

A folding chair includes a seat surface and a frame. The frame includes two front leg bars, two rear leg bars, two backrest bars, front crossed bars arranged between the two front leg bars, rear crossed bars arranged between the two rear leg bars, left crossed bars arranged between the left front leg bar and the left rear leg bar, and right crossed bars arranged between the right front leg bar and the right rear leg bar. The upper portions of the two front leg bars are provided with front hinge members. The front sliding sleeves are provided on the two front leg bars under the front hinge members. The stop lockers are provided on the two rear leg bars. The backrest sliding sleeves are provided on the two backrest bars.

6 Claims, 10 Drawing Sheets

(56) References Cited

U.S. PATENT DOCUMENTS

| | | | | |
|---|---|---|---|---|
| 6,926,356 | B2 * | 8/2005 | Chen | A47C 4/286 297/45 X |
| 7,641,276 | B1 * | 1/2010 | Chen | A47C 4/286 297/42 X |
| 7,758,111 | B2 * | 7/2010 | Chen | A47C 4/30 297/16.2 |
| 7,942,476 | B2 * | 5/2011 | Chen | A47C 4/286 297/42 X |
| 8,100,469 | B2 * | 1/2012 | Lougee | A47C 4/286 297/58 |
| 8,251,442 | B2 * | 8/2012 | Grace | A47C 4/286 297/45 X |
| 8,511,747 | B2 * | 8/2013 | Lougee | A47C 9/105 297/16.2 |
| 8,696,052 | B2 * | 4/2014 | Zhu | A47C 4/28 297/45 X |
| 8,864,222 | B2 * | 10/2014 | Grace | A47C 4/286 297/35 |
| 9,066,606 | B1 * | 6/2015 | Archer-Hall | A47D 1/023 |
| 9,204,729 | B2 * | 12/2015 | Frankel | A47C 1/14 |
| 9,254,044 | B2 * | 2/2016 | Dudik | A47C 7/70 |
| 9,532,652 | B2 * | 1/2017 | Choi | A47C 4/48 |
| 9,585,481 | B2 * | 3/2017 | Choi | A47C 4/286 |
| 9,622,583 | B1 * | 4/2017 | Lv | A47C 5/10 |
| 10,104,971 | B1 * | 10/2018 | Yang | A47C 7/462 |
| 10,182,655 | B1 * | 1/2019 | Frankel | A47C 4/286 |
| 10,206,510 | B2 * | 2/2019 | Choi | A47C 4/286 |
| 10,278,506 | B2 * | 5/2019 | Yang | A47C 4/28 |
| 10,617,212 | B1 * | 4/2020 | Tsai | A47C 3/12 |
| 10,631,648 | B1 * | 4/2020 | Tsai | A47C 4/286 |
| 10,660,443 | B1 * | 5/2020 | Tsai | A47C 4/38 |
| 2009/0174230 | A1 * | 7/2009 | Chen | A47C 4/286 297/16.1 |
| 2010/0072790 | A1 * | 3/2010 | Pleiman | A47C 4/286 297/45 |
| 2010/0237665 | A1 * | 9/2010 | Grace | A47C 4/46 297/16.2 |
| 2010/0314914 | A1 * | 12/2010 | Mazzola | A47C 3/34 297/16.2 |
| 2014/0138990 | A1 * | 5/2014 | Chesness | A47C 4/42 297/16.1 X |
| 2014/0217784 | A1 * | 8/2014 | Chen | A47C 4/286 297/35 |
| 2014/0327277 | A1 * | 11/2014 | Dudik | A47C 4/283 297/16.1 |
| 2016/0100688 | A1 * | 4/2016 | Grace | A47C 4/286 297/17 |
| 2016/0166062 | A1 * | 6/2016 | Lovley, II | A47C 4/28 297/16.1 |
| 2019/0045908 | A1 * | 2/2019 | Zhu | A45F 3/04 |
| 2019/0374033 | A1 * | 12/2019 | Grace | A45F 3/14 |

FOREIGN PATENT DOCUMENTS

| | | | |
|---|---|---|---|
| CN | 203986999 | U | 12/2014 |
| CN | 105640103 | A | 6/2016 |
| CN | 205548051 | U | 9/2016 |
| JP | 2015186648 | A | 10/2015 |

* cited by examiner

FOLDING CHAIR

CROSS REFERENCE TO THE RELATED APPLICATIONS

This application is the national phase entry of International Application No. PCT/CN2017/000128, filed on Jan. 22, 2017, which is based upon and claims priority to Chinese Patent Application No. 201610069723.6, filed on Feb. 1, 2016, the entire contents of which are incorporated herein by reference.

TECHNICAL FIELD

The present invention relates to the field of structural design of tables and chairs, in particular to a folding chair suitable for occasions such as traveling, outdoor, beach, and the like.

BACKGROUND

The folding chairs are increasingly used in public places due to its advantages including easy to move around, space saving, handy, foldable, etc. As people's living standards are gradually upgraded, outdoor sports become more popular, and there is an increasing demand for outdoor products, so higher requirements are put forward for outdoor recreation furniture such as folding chairs. The folding chairs available now have the disadvantages of large volume after folding and low structural stability which induce a need to improve the folding chairs.

SUMMARY

The objective of the present invention is to provide a folding chair with the problems in the prior art addressed. The problems include the large volume after folding and the low structural stability, etc.

The technical solutions used to achieve the objective of the present invention are as follows.

A folding chair, includes a seat surface and a frame. The frame includes two front leg bars, two rear leg bars, two backrest bars, front crossed bars provided between the two front leg bars, and rear crossed bars provided between the two rear leg bars, left crossed bars provided between a left front leg bar and a left rear leg bar, and right crossed bars provided between a right front leg bar and a right rear leg bar. Upper portions of the two front leg bars are each provided with a front hinge member. A front sliding sleeve is provided on each of the two front leg bars under the front hinge member. The two rear leg bars are each provided with a stop locker. The two backrest bars are each provided with a backrest sliding sleeve.

Two upper terminals of the front crossed bars are respectively hinged to the front hinge members on the two front leg bars, and two lower terminals of the front crossed bars are respectively hinged to the two front sliding sleeves.

Among two front terminals of the left crossed bars and two front terminals of the right crossed bars, terminals at an upper side are correspondingly hinged to the front leg bars, and terminals at a lower side are hinged to the front sliding sleeves. Among two rear terminals of the left crossed bars and two rear terminals of the right crossed bars, terminals at the upper side are correspondingly hinged to the backrest sliding sleeves, and terminals at the lower side are hinged to the stop lockers.

The left rear leg bar is hinged to the terminals at the upper side of the left crossed bars, and the right rear leg bar is hinged to the terminals at the upper side of the right crossed bars.

Two upper terminals of the rear crossed bars are respectively hinged to the backrest sliding sleeves on the two backrest bars, and two lower terminals of the rear crossed bars are respectively hinged to the stop lockers.

Based on the above-mentioned solution, the stop locker includes two side plates and a rear plate. A clamping groove is formed within the two side plates and the rear plate. The rear leg bar passes through the clamping groove when the folding chair is unfolded. The two side plates are respectively provided on an inner side and an outer side of the rear leg bar. The rear plate is located at a rear side of the rear leg bar. The rear plate and the two side plates are fixedly connected or formed as a single whole piece. Lower portions of the two side plates are hinged to the rear leg bars. The hinge members are provided on the two side plates, respectively. The lower terminal of the rear terminals of the left crossed bars and a lower end of a left backrest bar are hinged to the hinge member on the side plate at the outer side of the stop locker on the left. The lower terminal of left terminals of the rear crossed bars is hinged to the hinge member on the side plate at the inner side of the stop locker on the left. Correspondingly, the lower terminal of the rear terminals of the right crossed bars and a lower end of a right backrest bar are hinged to the hinge member on the side plate at the outer side of the stop locker on the right; and the lower terminal of right terminals of the rear crossed bars is hinged to the hinge member on the side plate at the inner side of the stop locker on the right.

Based on the above-mentioned solution, the stop locker is a locking slider. The locking slider includes a rear leg bar sleeve, a locking pin, a lever member, a compression spring and a pin rod. The rear leg bar sleeve is provided with a through hole having a shape identical to a shape of the rear leg bar. The locking slider is sleeved on the rear leg bar through the through hole. A mounting member configured to mount the lever member is provided on the rear leg bar sleeve. A pin rod hole configured to allow the pin rod to pass through is provided in the mounting member. The lever member is rotatably connected to the rear leg bar sleeve by the pin rod. The locking pin is hinged to a free end of the lever member. The rear leg bar sleeve is provided with a locking pin hole at a position aligned to the locking pin. The locking pin passes through the locking pin hole, and is perpendicular to the rear leg bar. The other free end of the lever member is provided with a locking button. The compression spring is provided between the locking button and the rear leg bar sleeve. The compression spring is arranged against the locking button to make the locking pin on the lever member closely press against the rear leg bar.

Based on the above-mentioned solution, the front leg bars, the rear leg bars, the backrest bars, the front crossed bars, the rear crossed bars, the left crossed bars and the right crossed bars are hollow and tubular.

Based on the above-mentioned solution, the seat surface covers a seat cushion portion and a backrest portion of the frame.

The folding chair of the present invention has the following advantages: the folding chair of the present invention has a simple structure and a user-friendly operation. In the folded state, the folding chair is bundled up, so the folded chair is small in size and easy to carry and transport. In the unfolded state, the stop locker is steady and reliable, and the folding joints are less likely to become loosened, which is safe and reliable in use.

Figure 1:
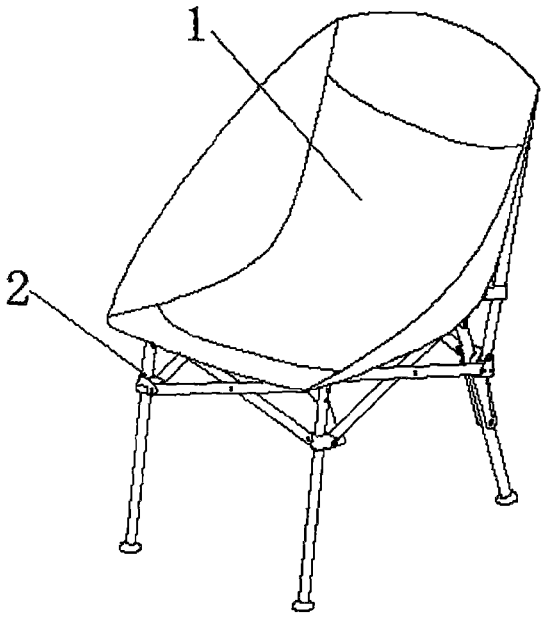
FIG. 1 is a structural schematic diagram of a folding chair of the present invention.

In the drawings, 1: seat surface, 2: frame, 3: front leg bar, 4: rear leg bar, 5: backrest bar, 6: front crossed bars, 7: rear crossed bars, 8: left crossed bars, 9: right crossed bars, 10: front sliding sleeve, 11: backrest sliding sleeve, 12: stop locker, 13: side plate, 14: rear plate, 15: rear leg bar sleeve, 16: locking pin, 17: lever member, 18: compression spring, 19: pin rod, 20: clamping groove, 21: through hole, 22: pin rod hole, 23 front hinge member, 24 hinge member.

DETAILED DESCRIPTION OF THE EMBODIMENTS

Embodiment 1

Figure 2:
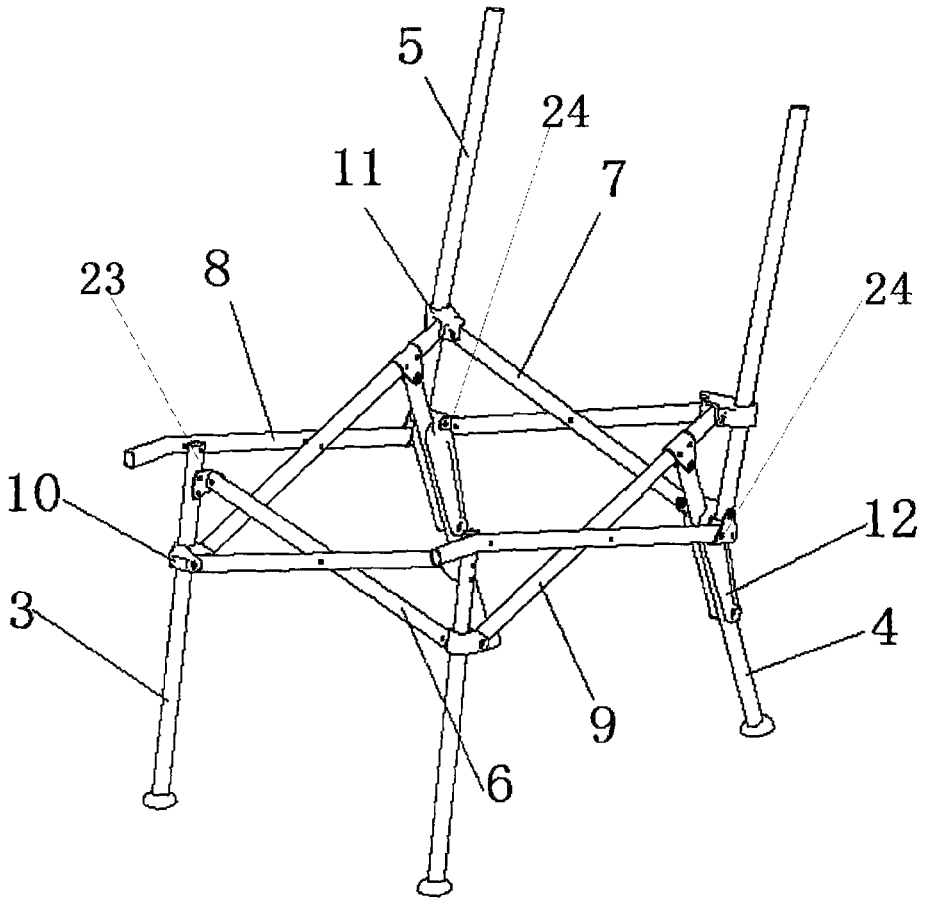
FIG. 2 is a schematic diagram showing the unfolded state of a frame of the folding chair according to Embodiment 1.
Figure 3:
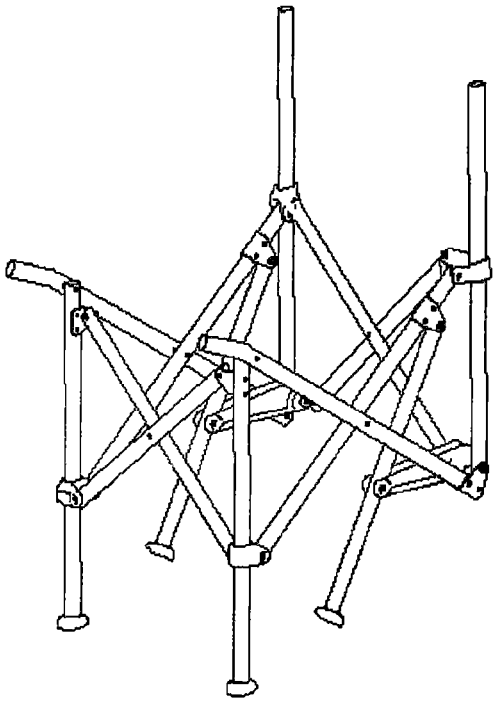
FIG. 3 is a schematic diagram showing the half folded state of the frame according to Embodiment 1.
Figure 4:
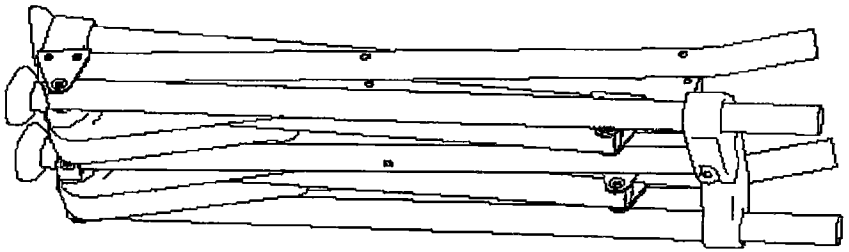
FIG. 4 is a schematic diagram showing the fully folded state of the frame according to Embodiment 1.
Figure 5:
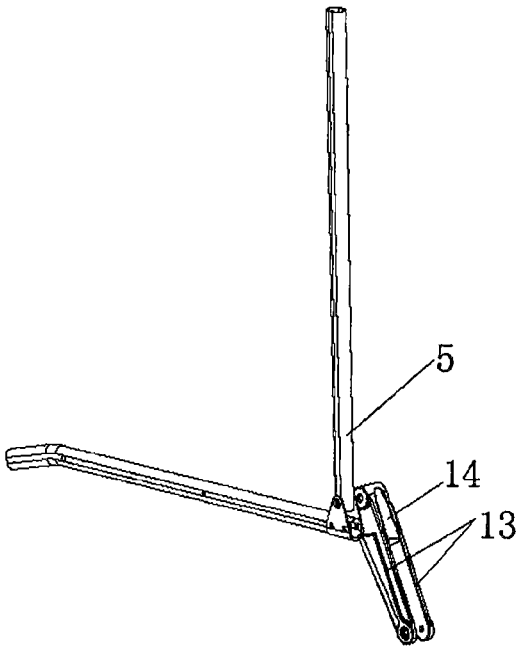
FIG. 5 is a structural schematic diagram of a stop locker according to Embodiment 1.

As shown in FIGS. 1-5, the folding chair includes the seat surface 1 and the frame 2. The seat surface 1 covers the seat cushion portion and the backrest portion of the frame 2. The frame 2 includes the two front leg bars 3, the two rear leg bars 4, the two backrest bars 5, the front crossed bars 6 arranged between the two front leg bars 3, the rear crossed bars 7 arranged between the two rear leg bars 4, the left crossed bars arranged between the left front leg bar 3 and the left rear leg bar 4, and the right crossed bars arranged between the right front leg bar 3 and the right rear leg bar 4. The upper portions of the two front leg bars 3 are respectively provided with a front hinge member 23. The two front leg bars 3 are provided with the front sliding sleeves 10 under the front hinge members 23. The two rear leg bars 4 are respectively provided with the stop locker 12. The two backrest bars 5 are respectively provided with the backrest sliding sleeve 11.

The two upper terminals of the front crossed bars 6 are respectively hinged to the front hinge members 23 on the two front leg bars 3, and the two lower terminals of the front crossed bars 6 are respectively hinged to the two front sliding sleeves 10.

Among two front terminals of the left crossed bars and two front terminals of the right crossed bars, the upper terminals are correspondingly hinged to the front leg bars 3, and the lower terminals are hinged to the front sliding sleeves 10. Among two rear terminals of the left crossed bars and two rear terminals of the right crossed bars, the upper terminals are correspondingly hinged to the backrest sliding sleeves 11, and the lower terminals are hinged to the stop lockers 12. The left rear leg bar 4 is hinged to the upper terminals of the left crossed bars, and the right rear leg bar 4 is hinged to the upper terminals of the right crossed bars.

Two upper terminals of the rear crossed bars 7 are respectively hinged to the backrest sliding sleeves 11 on the two backrest bars 5, and two lower terminals of the rear crossed bars 7 are respectively hinged to the stop lockers 12.

In the above-mentioned solution, the stop locker 12 includes the two side plates 13 and the rear plate 14. The clamping groove 20 is formed within the two side plates 13 and the rear plate 14. When the folding chair is unfolded, the rear leg bar 4 passes through the clamping groove 20. The two side plates 13 are respectively provided on the inner side and the outer side of the rear leg bar 4. The rear plate 14 is located at the rear side of the rear leg bar 4. The rear plate 14 and the two side plates 13 are fixedly connected or formed as a single whole piece. The lower portions of the two side plates 13 are hinged to the rear leg bars 4. The hinge members 24 are respectively provided on the two side plates 13. The lower terminal of the rear terminals of the left crossed bars and the lower end of the backrest bar 5 on the left side are hinged to the hinge member 24 on the side plate 13 at the outer side of the stop locker 12 on the left. The lower terminal on the left side of the rear crossed bars 7 is hinged to the hinge member 24 on the side plate 13 at the inner side of the stop locker 12 on the left. Correspondingly, the lower terminal of the rear terminals of the right crossed bars and the lower end of the backrest bar 5 on the right side are hinged to the hinge member 24 on the side plate 13 at the outer side of the stop locker 12 on the right. The lower terminal on the right side of the rear crossed bars 7 is hinged to the hinge member 24 on the side plate 13 at the inner side of the stop locker 12 on the right.

In the unfolded state of the folding chair of the present invention, the upper and lower included angles of the front crossed bars 6, the rear crossed bars 7, the left crossed bars 8 and the right crossed bars 9 are obtuse angles. The rear leg bar 4 passes through the clamping groove 20 of the stop locker 12. The rear plate 14 of the stop locker 12 acts to limit the position of the rear leg bar 4. The rear leg bar 4 is inclined forward. The backrest bar 5 applies force on the stop locker 12 to cause the inner wall of the clamping groove 20 of the stop locker 12 to closely contact the rear leg bar 4, so the stop locking is steadier, the unfolded state of the folding chair is more stable, and the folding chair is safer to use. When the folding chair is to be folded, the backrest bar 5 is moved forward by one hand, and the left crossed bars or the right crossed bars are lifted upward by the other hand, so to release the stop locking. Then, the front crossed bars 6, the rear crossed bars 7, the left crossed bars 8 and the right crossed bars 9 are folded to minimize the volume of the folding chair. The folding chair of the present invention has a simple structure and a user-friendly operation. In the folding state, the folding chair is bundled up, so the folding chair is small in size and easy to carry and transport. In the unfolded state, the stop locking is steady and reliable, and the folding joints are less likely to become loosened, so the folding chair is safe and reliable in use.

Embodiment 2

Figure 6:
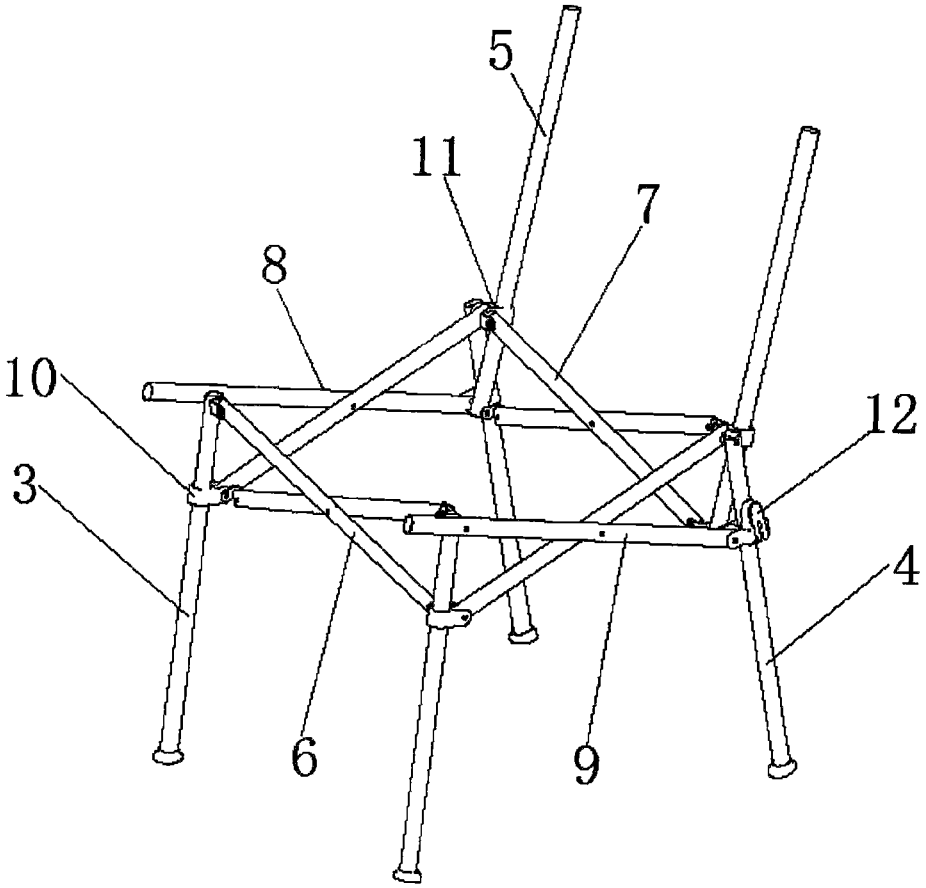
FIG. 6 is a schematic diagram showing the unfolded state of a frame of a folding chair according to Embodiment 2.
Figure 7:
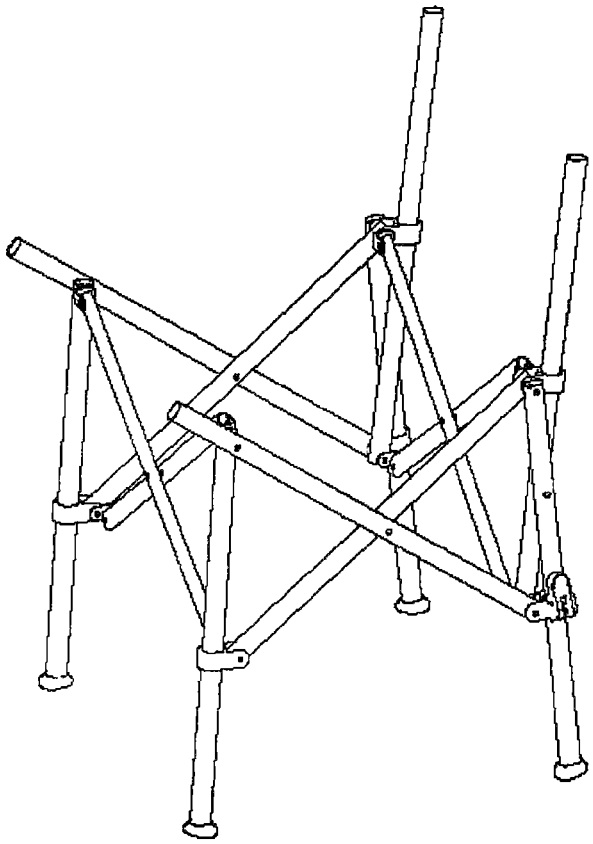
FIG. 7 is a schematic diagram showing the half folded state of the frame according to Embodiment 2.
Figure 8:
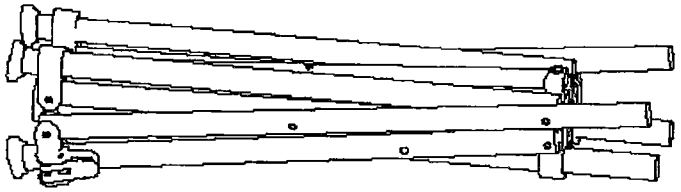
FIG. 8 is a schematic diagram showing the fully folded state of the frame according to Embodiment 2.
Figure 9:
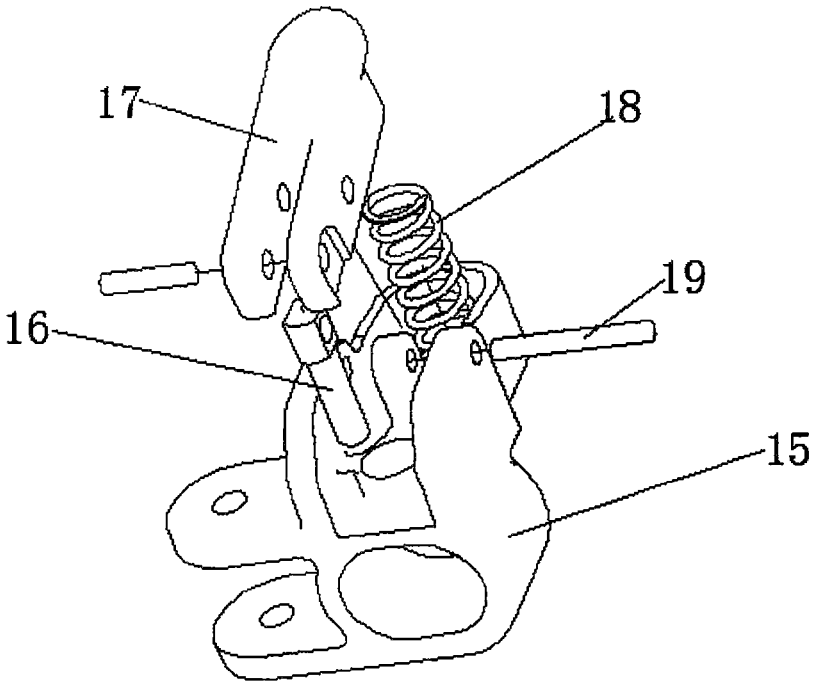
FIG. 9 is a structural schematic diagram of a stop locker according to Embodiment 2.
Figure 10:
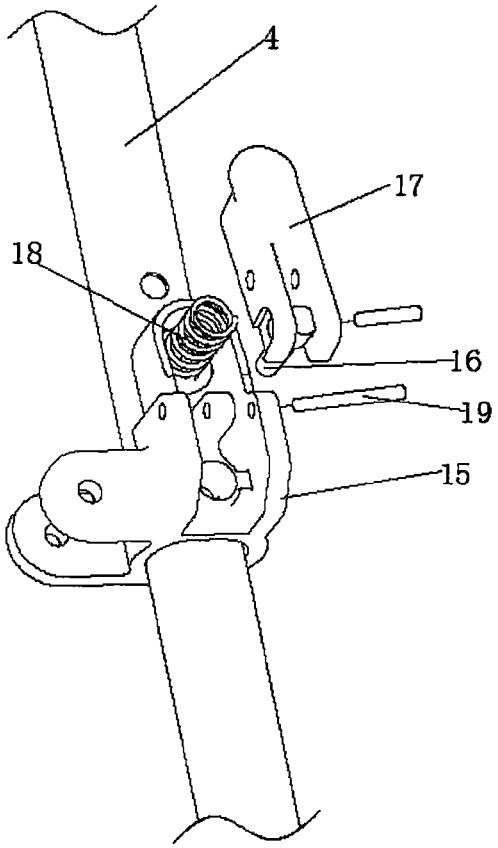
FIG. 10 is a schematic diagram showing the connection of the stop locker and the rear leg bar according to Embodiment 2.

As shown in FIGS. 6-10, Embodiment 2 is different from Embodiment 1 in that the stop locker 12 is the locking slider.

The locking slider includes the rear leg bar sleeve 15, the locking pin 16, the lever member 17, the compression spring 18 and the pin rod 19. The rear leg bar sleeve 15 is provided with a through hole 21 having a shape identical to the shape of the rear leg bar 4. The locking slider is sleeved on the rear leg bar 4 through the through hole 21. The mounting member configured to mount the lever member 17 is provided on the rear leg bar sleeve 15. The pin hole configured to allow the pin rod 19 to pass is provided in the mounting member. The lever member 17 is rotatably connected to the rear leg bar sleeve 15 by the pin rod 19. The locking pin 16 is hinged to one free end of the lever member 17. The locking pin hole is provided on the rear leg bar sleeve 15 at a position aligned to the locking pin 16. The locking pin 16 passes through the locking pin hole and is perpendicular to the rear leg bar 4. The other free end of the lever member 17 is provided with the locking button. The compression spring 18 is provided between the locking button and the rear leg bar sleeve 15. The compression spring 18 is arranged against the locking button, so that the locking pin 16 on the lever member 17 closely presses against the rear leg bar 4. By configuring the stop locker 12, the compression spring 18 applies force to the locking pin 16 by the lever member to make the locking pin 16 closely press against the rear leg bar 4, so as to achieve the locking of the stop locker 12 and the rear leg bar 4. By doing so, the unfolding state of the folding chair is more stable. When the folding chair is to be folded, the locking button is pressed by one hand to realize the unlocking, and the backrest bar is moved downward by the other hand, so the folding of the folding chair is completed. In order to enhance the locking of the locking pin 16 and the rear leg bar 4, structures such as pattern, the blind hole, the through hole, the ratchet, etc., are provided on the rear leg bar 4 at a position aligned to the locking pin 16, so the action force between the locking pin 16 and the rear leg bar 4 is increased, the folding chair is more stable in the unfolded state. The frame 2 will not be unintentionally folded, thereby ensuring the user's safety. In the solution of Embodiment 2, the folding chair is folded and unfolded in a more convenient way. After folding, the folding chair is bundled up, so the folding chair is small in size, and easy to carry and transport.

The above-mentioned embodiments are intended to illustrate the specific implementations of the present invention, rather than limit the scope of the present invention. A person skilled in the art can make various modifications and changes to obtain the corresponding equivalent technical solutions without departing from the spirit and scope of the present invention. Hence, all equivalent technical solutions should be covered by the protection scope of the present invention.

What is claimed is:

1. A folding chair, comprising: a seat surface and a frame, wherein the frame comprises two front leg bars comprising a left front leg bar and a right front leg bar, two rear leg bars comprising a left rear leg bar and a right rear leg bar, two backrest bars comprising a left backrest bar and a right backrest bar, front crossed bars arranged between the two front leg bars, rear crossed bars arranged between the two rear leg bars, left crossed bars arranged between the left front leg bar and the left rear leg bar, and right crossed bars arranged between the right front leg bar and the the right rear leg bar; upper portions of the two front leg bars are each provided with a front hinge member; front sliding sleeves are respectively provided on the two front leg bars under the front hinge members; stop lockers, comprising a left stop locker and a right stop locker, are respectively provided on the two rear leg bars; and backrest sliding sleeves are respectively provided on the two backrest bars;

two upper terminals of the front crossed bars are respectively hinged to the front hinge members on the two front leg bars, and two lower terminals of the front crossed bars are respectively hinged to the two front sliding sleeves;

two front terminals of the left crossed bars and two front terminals of the right crossed bars comprise an upper front terminal and a lower front terminal, wherein the upper front terminal is correspondingly hinged to the two front leg bars, and the lower terminal is hinged to the front sliding sleeves; two rear terminals of the left crossed bars and two rear terminals of the right crossed bars comprise an upper rear terminal and a lower rear terminal, wherein the upper rear terminal is correspondingly hinged to the backrest sliding sleeves, and the lower rear terminal is hinged to the stop lockers;

the left rear leg bar is hinged to upper terminals of the left crossed bars, and the right rear leg bar is hinged to upper terminals of the right crossed bars;

two upper terminals of the rear crossed bars are respectively hinged to the backrest sliding sleeves on the two backrest bars, and two lower terminals of the rear crossed bars are respectively hinged to the stop lockers;

wherein each of the stop lockers comprises two side plates and a rear plate, wherein a clamping groove is formed within the two side plates and the rear plate; each rear leg bar passes through the clamping groove when the folding chair is unfolded; the two side plates are respectively provided on an inner side and an outer side of the rear leg bar; the rear plate is located at a rear side of the rear leg bar; the rear plate and the two side plates are fixedly connected or form a single whole piece; lower portions of the two side plates are hinged to the rear leg bar; hinge members are respectively provided on the two side plates; a lower terminal of the rear terminals of the left crossed bars and a lower end of the left backrest bar are hinged to the hinge member on the side plate at an outer side of the left stop locker; a lower terminal of left terminals of the rear crossed bars is hinged to the hinge member on the side plate at an inner side of the left stop locker; a lower terminal of the rear terminals of the right crossed bars and a lower end of the right backrest bar are hinged to the hinge member on the side plate at an outer side of the right stop locker; and a lower terminal of right terminals of the rear crossed bars is hinged to the hinge member on the side plate at an inner side of the right stop locker.

2. The folding chair according to claim 1, wherein the two front leg bars, the two rear leg bars, the backrest bars, the front crossed bars, the rear crossed bars, the left crossed bars and the right crossed bars are hollow and tubular.

3. The folding chair according to claim 1, wherein the seat surface covers a seat cushion portion and a backrest portion of the frame.

4. A folding chair, comprising: a seat surface and a frame, wherein the frame comprises two front leg bars comprising a left front leg bar and a right front leg bar, two rear leg bars comprising a left rear leg bar and a right rear leg bar, two backrest bars comprising a left backrest bar and a right backrest bar, front crossed bars arranged between the two front leg bars, rear crossed bars arranged between the two rear leg bars, left crossed bars arranged between the left front leg bar and the left rear leg bar, and right crossed bars arranged between the right front leg bar and the right rear leg bar; upper portions of the two front leg bars are each provided with a front hinge member; front sliding sleeves are respectively provided on the two front leg bars under the front hinge members; stop lockers, comprising a left stop locker and a right stop locker, are respectively provided on the two rear leg bars; and backrest sliding sleeves are respectively provided on the two backrest bars;

two upper terminals of the front crossed bars are respectively hinged to the front hinge members on the two front leg bars, and two lower terminals of the front crossed bars are respectively hinged to the two front sliding sleeves;

two front terminals of the left crossed bars and two front terminals of the right crossed bars comprise an upper front terminal and a lower front terminal, wherein the upper front terminal is correspondingly hinged to the two front leg bars, and the lower terminal is hinged to the front sliding sleeves; two rear terminals of the left crossed bars and two rear terminals of the right crossed bars comprise an upper rear terminal and a lower rear terminal, wherein the upper rear terminal is correspondingly hinged to the backrest sliding sleeves, and the lower rear terminal is hinged to the stop lockers;

the left rear leg bar is hinged to upper terminals of the left crossed bars, and the right rear leg bar is hinged to upper terminals of the right crossed bars;

two upper terminals of the rear crossed bars are respectively hinged to the backrest sliding sleeves on the two backrest bars, and two lower terminals of the rear crossed bars are respectively hinged to the stop lockers;

wherein the stop locker is a locking slider, the locking slider comprises a rear leg bar sleeve, a locking pin, a lever member, a compression spring and a pin rod, wherein the rear leg bar sleeve is provided with a through hole having a shape identical to a shape of the rear leg bar; the locking slider is sleeved on the rear leg bar through the through hole; a mounting member configured to mount the lever member is provided on the rear leg bar sleeve; a pin rod hole is provided in the mounting member, wherein the pin rod is configured to pass through the pin rod hole; the lever member is rotatably connected to the rear leg bar sleeve by the pin rod; the locking pin is hinged to a first free end of the lever member; a locking pin hole is provided on the rear leg bar sleeve at a position aligned to the locking pin; the locking pin passes through the locking pin hole and is perpendicular to the rear leg bar; a second free end of the lever member is provided with a locking button; the compression spring is provided between the locking button and the rear leg bar sleeve; the compression spring is arranged against the locking button; and the locking pin on the lever member closely presses against the rear leg bar.

5. The folding chair according to claim 4, wherein the two front leg bars, the two rear leg bars, the backrest bars, the front crossed bars, the rear crossed bars, the left crossed bars and the right crossed bars are hollow and tubular.

6. The folding chair according to claim 4, wherein the seat surface covers a seat cushion portion and a backrest portion of the frame.

* * * * *